United States Patent [19]

Gre

[11] 4,087,956

[45] May 9, 1978

[54] MACHINE FOR MANUFACTURE OF A CABLE FROM SINGLE WIRES

[75] Inventor: Michel Jean Gre, Bar-le-Duc, France

[73] Assignee: Rhone-Poulenc-Textile, Paris, France

[21] Appl. No.: 703,561

[22] Filed: Jul. 8, 1976

[30] Foreign Application Priority Data

Jul. 23, 1975 France ..... 75 23228

[51] Int. Cl.[2] ..... D07B 3/00; D07B 3/12

[52] U.S. Cl. ..... 57/58.54; 57/58.86; 57/156

[58] Field of Search ..... 57/58.49, 58.52, 58.54, 57/58.55, 58.57, 58.59, 58.61, 58.65, 58.67, 58.68, 58.7, 58.72, 58.78, 58.83, 58.86, 156, 160, 34 R, 3, 13

[56] References Cited

U.S. PATENT DOCUMENTS

| | | | |
|---|---|---|---|
| 2,593,984 | 4/1952 | Clary et al. | 57/58.55 |
| 3,355,867 | 12/1967 | Yoshida | 57/58.55 X |
| 3,564,831 | 2/1971 | Bonnabaud et al. | 57/58.52 |
| 3,793,819 | 2/1974 | Madalozzo et al. | 57/58.52 |
| 3,807,156 | 4/1974 | Gre | 57/58.52 |
| 3,828,538 | 8/1974 | Yoshida et al. | 57/58.54 |

*Primary Examiner*—Donald Watkins
*Attorney, Agent, or Firm*—Sherman & Shalloway

[57] ABSTRACT

A machine for continuous stranding and cabling, for the manufacture of a cable from single wires, the machine including a stranding battery provided with a plurality of single-twist or double-twist delivery stranding spindles, a double-twist cabling device, which includes means for winding up the cable located after the stranding battery, and two twisters associated with the cabling device. Traction means are provided for the strands and for the cable, with two traction stages, one at the stranding stage and one at the cabling stage. The peripheral or drive speed of the traction means at the stranding stage is equal to or greater than the peripheral speed of the traction means at the cabling stage, whereby the tension upstream of the cabling means is reduced.

15 Claims, 7 Drawing Figures

MACHINE FOR MANUFACTURE OF A CABLE FROM SINGLE WIRES

The present invention relates to a machine for the manufacture of a cable from single wires. In particular, it relates to a machine for the manufacture of cables consisting of an assembly of metal wires such as those used for the reinforcement of carcasses or sidewalls of tyres. The term cable is applied to the finished product consisting of an assembly, formed by twisting, of individual wires, the assembly being produced in one or two stages. If the cable is manufactured in a single stage, it is a cable of single wires. If the cable is manufactured in two stages, the first stage consists of producing a strand (an intermediate product consisting of an assembly of single wires, formed by twisting, in a single stage), and the second stage consists of producing the finished cable by assembling several strands by twisting. This is then a cable of strands.

The cables used for the manufacture of tyre carcasses, in particular tyres for heavy vehicles, must have good tensile strength (i.e. 150 to 300 kg or more) and good resistance to fatigue, so as to tolerate deformations in use.

Furthermore, they must have good suppleness so as to fold easily around the bead wire. These conditions necessitate manufacturing a cable of strands or of single wires from a large number of fine individual wires (for example 20 to 40 wires or more) since, for a given tensile strength, the finer and more numerous the individual wires are, the better is the resistance to fatigue.

Generally, to obtain such cables, strands comprising a small number of wires are manufactured in a first stage, and these strands are then assembled by twisting, in a second stage, to form a cable conforming to the required characteristics. For certain manufacturing processes, lapped cable is used; a lapped cable is a cable around which a fine wire, called lapping wire, has been wound, with a short pitch.

At the present time the conventional method of manufacture of cables of strands comprises two separate operations carried out discontinuously on two different machines, namely stranding and cabling. If it is desired to manufacture a lapped cable, the lapping constitutes a third operation which can be carried out either continuously on a cabling machine equipped with a lapping head, or discontinuously on a lapping machine.

The totality of these operations, carried out discontinuously, constitutes a rather long and expensive process, which necessitates transfer from machine to machine.

U.S. Pat. No. 2,546,977 of CLARY, has disclosed a stranding and cabling machine which makes it possible to manufacture cables of strands in two operations carried out continuously. This machine comprises a stranding part and a cabling part. The stranding part consists of an assembly of double-twist delivery spindles, each spindle carrying the bobbins of single wire. An overtwist device of the false twist type is located at the outlet of each spindle in order to set the twist of each strand by exceeding the elastic limit. The strands are then assembled at the inlet of a convergence die and the assembly is drawn by a capstan towards the means of cabling.

The means of cabling comprise a double-twist wind-up cabling spindle of the double loop type, with a collecting bobbin for the cable located inside the loops and supported by a cradle which is held stationary. The single capstan is mounted so as to revolve about the axis of the cabling spindle. It revolves in the same direction as the said spindle, at a speed twice that of the latter. This machine thus makes it possible to produce cables of strands continuously. However, in order to be useable, in particular in tyre carcasses, a cable must in addition to the properties of suppleness and tensile strength already mentioned possess the following properties; it must remain straight in the free state; it must not open up when cut, and its twist must be stable, that is to say its twist reaction when it is unwound from the bobbin on which it has been collected must be low (at most equal to 0.5 turn/m). Now it is known from experience that to achieve these properties in the conventional processes it is necessary to adjust devices such as preformers, straighteners and twisters, with which the conventional machines are equipped.

Now on the machine according to U.S. Pat. No. 2,546,977 there is neither a preformer nor a twister at the cabling stage. Furthermore, the strands and the cable together are pulled by a single capstan. This results in an extremely high take-off tension in the cable, which is detrimental to the quality of the product (risk of breakage, and poor setting of the twist) and prejudicial as regards the mechanical wear of the components of the machine.

A machine is also known, from U.S. Pat. No. 3,828,538 of YOSHIDA ENGINEERING, for the continuous manufacture of a cable formed from wires which are first twisted individually on one another and then assembled by twisting and lapped. It comprises a twisting unit consisting of double-twist delivery spindles, a cabling and lapping unit in two parts, of the double-twist type, with a horizontal axis, a traction capstan at the twisting stage and two capstans at the cabling and lapping stage, with control of the tension between these two latter capstans. However, this is a machine for the manufacture of cables from single wires and not of cables from strands. Furthermore, it is concerned with a particular product of which the twist is not stable, the untwisting being prevented by the lapping, which is a strong lapping, having a binding effect. The machine does not comprise a twister for stabilising the twist. Furthermore, the problems of control of the tension between the twisting stage and the cabling stage are not touched on.

According to the present invention, we provide a machine for continuous stranding and cabling for the manufacture of a cable from single wires, such machine comprising a stranding battery provided with a plurality of single-twist or double-twist delivery stranding spindles, a double-twist cabling device comprising means of winding up the cable, located after the stranding battery, traction means for the strands and the cable, with two traction stages, one at the stranding stage and the other at the cabling stage, the peripheral speed of the traction means at the stranding stage being equal to or greater than the peripheral speed of the traction means at the cabling stage, and two twisters associated with the cabling device.

Such a machine which makes it possible continuously to manufacture a cable and, if desired, a lapped cable, from single wires, the said cable having all the properties required for its use.

The machine can furthermore comprise a preformer for preforming the strands before they are assembled to form a cable. The preformer may comprise at least three passages for each strand so as to cause each to describe a curvilinear path over a brief length which is a function of the cabling pitch. The object of the preformer is to prevent the cable opening up when cut.

The stranding battery can comprise a single frame on which are mounted the stranding spindles. The number of spindles $x$ determines the maximum number of strands involved in the making up of the cable which it is desired to obtain by using the machine by itself, but it is possible only to use some of the spindles, and also "to inject", into the cable being formed, one or more supplementary strands by conventional means external to the machine. Advantageously, the number of spindles is between two and fifteen and the spindles are preferably aligned.

The spindles are of any known type, such as single-twist spindles or double-twist spindles although it is preferred to use vertical double-twist delivery spindles of the general type described in French Pat. No. 2,183,429. Each spindle carries a number $y$ of wires, which depends on the characteristics of the product which it is desired to obtain and which can vary from one spindle to the next. The $y$ wires can be carried by $y$ bobbins at the rate of one wire per bobbin, as shown in French Pat. No. 2,183,429. Preferably, the $y$ wires can also be delivered from a single bobbin. However, it is also possible to use a combination of the two solutions; thus, it is possible to have, for example, one bobbin with $z$ wires, and $y$–$z$ bobbins each with one wire. The number $y$ of wires of which each strand consists is advantageously between two and fifteen. Delivery (from the bobbins) can be by drawing the wire off the end of the bobbin, or by unwinding from the bobbin, with or without a system of braking of the bobbins. Preferably, the wire is unwound and each spindle comprises a system of braking the bobbins, which system has a variable action in accordance with the reduction in weight of the coil, thus making it possible to keep the delivery tension constant. The spindles may be driven by means of a main drive shaft which extends over the entire length of the frame and is driven by a motor.

Advantageously, the motor also drives the cabling unit, the twisters as well as the traction means for the strands and cable.

$x$ power take-off points, with change of angle, are arranged on the frame for individually and independently driving the $x$ spindles. The individual means of driving each spindle comprise means of reversing the direction of rotation and means of regulating the speed. The $x$ spindles are thus independent from the point of view of direction and magnitude of the twist. These constructional arrangements make it possible to obtain, at the outlet of the stranding battery, a bundle of $x$ strands each comprising $y$ wires, $y$ being able to vary from spindle to spindle, as can the diameter of the single wires, the magnitude of the twist and the direction of the twist.

The stranding battery furthermore carries traction means for the first traction stage (stranding stage), the system for driving these means, and a system for guiding the strands as far as the cabling unit. It is advantageously equipped with a hood for safety and sound insulation. The hood comprises a top, preferably made of one piece, a fixed rear part, and a front part provided with a movable flap for access to the spindles and to the end partitions. Dividing partitions are optionally located between the spindles so as to prevent possible damage. The hood can comprise portholes for visual supervision of the operations. It can also comprise means of cooling, consisting, for example, of a fan operating a high delivery and low pressure, mounted on one of the vertical end partitions and providing circulation of air along the entire hood. For this purpose, the dividing partitions are provided with openings for the air to pass from spindle to spindle.

The cabling device can comprise a frame located after the stranding battery. The frame carries a double-twist wind-up cabling spindle with a horizontal axis, the devices associated with the spindle, two twisters and, if appropriate, a lapping spindle. The cabling spindle is a spindle in which the cable describes a double-twist path by a suitable system. Preferably, the spindle has two diammetrically opposite loops, one loop serving for the passage of the cable and the other being provided for dynamic balancing purposes. The devices associated with the cabling spindle and located inside the space defined by the loops comprise, in the direction of travel of the cable: a straightening device for the cable, if appropriate, a broken strand detector, a traction capstan and its counting wheel, a bobbin for collecting the cable, mounted so as to be able to rotate and laying means. These devices are mounted on a cradle which is kept fixed and is surrounded by the loops. The cradle can also support a twister and the lapping spindle, where the latter is provided. The components of the cabling device are advantageously of any known type. Preferably, the straightening device consists of a bar with two crossed straighteners, carrying a device for the detection of broken strands. The laying device advantageously consists of a crossed-thread screw which is interchangeable in accordance with the types of coil produced. The means of winding-up comprising means of gripping the bobbins between centres and means of driving, preferably provided with a system for regulating the wind-up tension, when stopped or during running.

The components of the cabling device are preferably driven from the motor mentioned above, which drives the stranding spindles. The drive means can comprise a main shaft, an axial power take-off and any system which gives perfectly defined speed ratios between the various components, for example gears, a chain or a toothed belt. Means may be provided for reversing the direction of rotation of the cabling and lapping spindles and for regulating their speed and that of the other components of the cabling device, so as to be able to produce any possible combination of pitch, both in respect of magnitude and of direction.

The means of winding-up can be driven either from a power take-off located on the capstan of the cabling spindle, with interposition of any suitable system for regulating the tension (by friction, hysteresis or the like), or by means of an independent constant torque motor, with appropriate regulation controlled from outside the cabling spindle.

For the purposes of safety and sound insulation, the cabling device is preferably covered by a hood which can be opened.

The traction means of the cable and of the strands are provided with two traction stages. It has been found from experience that it is advantageous, both in stranding and in cabling and lapping, to use low tensions. It is thus not possible under these conditions to pull the cable, the strands and the wires all from a single capstan located in the cabling spindle. Furthermore, in view of the friction, the force which a single capstan would have to provide would be prohibitive for good resistance to mechanical wear of the wire guide devices.

In one embodiment of machine according to the invention, a primary capstan, or preferably a group of primary capstans, is located at the stranding battery and constitutes the first traction stage, and a secondary capstan, already referred to, is located inside the space defined by the path of the cable in the cabling device, and constituting the second traction stage. The first traction stage consists either of a single primary capstan with $x$ tracks drawing all the strands, or of $x$ capstans ($x$ = number of stranding spindles), each drawing one strand. The use of one independent capstan per spindle makes threading-up easier than in the case of a capstan with $x$ tracks. The primary capstan or capstans can be mounted on the stranding battery or on an independent frame located nearby. The fact of having two stages of capstans in series on one and the same cable presents problems of the control of the tension between the two capstans and requires careful control of their relative speeds. The secondary capstan must have a drive or peripheral speed slightly lower than the primary capstan, so as to avoid any stretching, this being arranged taking into account whether shortening due to twisting occurs. This difference in speed is of the order of 1 to 10% and advantageously of 2 to 6%.

The machine according to the invention can comprise means of controlling the delivery speed of the primary capstan or capstans in accordance with the traction speed of the secondary capstan. These means can be mechanical, electrical or of any other type. However, a simple means of control of the tension between the two capstans consists of winding a well-defined number of turns $n$ of the strands round the primary capstan so as to arrive at the grip/non-grip limit, that is to say so as to preserve the possibility of slip on this capstan. If the tension between the two stages of the capstan increases, the grip of the turns round the primary capstan tends to drive the strand at a higher speed and thus to overfeed the secondary capstan; hence the tension between the two stages decreases, and control is applied. Conversely, if the tension between the two capstan stages decreases, bearing in mind that the primary capstan is at the drive limit, a greater degree of slip occurs on the primary capstan and hence it feeds the secondary capstan at a lower speed and the tension between the two capstan stages increases. Here again, control is applied.

The machine according to the invention comprises two twisters. One of these is located at the entry of the cabling spindle. Its object is to impart to the cable its nominal twist whilst drawing off the suitable length of each strand, taking into account the position which the strand will occupy in the cable. Its speed of rotation is approximately equal to half the speed of the cabling spindle.

This first twister, of any known type, can comprise one or more pulleys. It can have two directions of rotation and its speed can be regulated. It may be driven from a main shaft by means comprising a device for varying the speed and a direction-changing gearbox. At the inlet of this twister there may be located a convergence die, at which the strands are assembled to form the cable.

The second twister is provided to stabilise the cabling twist. It is mounted on the cradle of the cabling spindle immediately upstream of the outlet for the cable from the loops of the cabling device. As with the first twister, it is of any known type with one or more pulleys. It can have two directions of rotation and it can be possible to regulate its speed during operation. However, advantageously the direction and speed of rotation of the second twister are determined beforehand in accordance with the type of product manufactured, and are kept fixed. Any adjustments are made by means of the first twister. Since the latter is located outside the space defined by the loops of the cabling device, its accessibility is good and it can easily be connected to means of varying its speed and its direction of rotation.

To obtain a cable of good quality which is free from faults requires the following conditions:

(a) assembly of the strands at the die must substantially take place under the nominal twist of the cable C, (b) at the inlet of the cabling spindle each strand must be drawn in to the exact length corresponding to the length required in the finished product (in fact, since the cable generally comprises a core strand, the length of the latter is less than the length of the external strands), and (c) the over-twist, by false twist, to set the true twist must be imparted to a cable wherein the strands have the same twist configuration as in the finished product.

Now it is known that when assembling by double twist, as in the case of assembling strands to form a cable, each strand is subjected not only to the assembling twist imparted to the cable but is also individually subjected to a twist of the same amount, and in the same direction, as the assembling twist C.

If the stranding twist T and the cabling (or assembling) twist are in opposite directions, each strand will thus be untwisted by an amount C.

Hence, to obtain, in the finished cable, a strand which has the desired nominal value T, this strand is manufactured with a twist T + C. The over-twist C which will be lost on cabling favours the stabilisation of the twist of the strands. The use of twisters makes it possible to complete the stabilisation of the twist of the strands and to stabilise the twist of the cable.

If the stranding twist T and the cabling twist C are in the same direction, during cabling each strand will be overtwisted by a value C.

During stranding, a strand of twist T-C will be formed.

On cabling, this strand will receive an additional twist C and a strand having the desired nominal value T will be obtained in the finished product.

As in the preceding case, the twist of the strands and of the cable is stabilised by means of twisters.

However, in the double-twist process, the cabling twist C is imparted in two stages. The untwist, or the supplementary twist, is thus also imparted in two stages. However, if the twist (or untwist) rises back from inside the cabling device up to the inlet of the latter or even beyond, in the normal way, without blockage, the twist will only reach its definitive value when the cable has left the loop. It is thus advantageous to locate the second twister on the cradle, at the outlet from the loops of cabling device where the strands and the cable have assumed their definitive twist. The combination of the two twisters, the selection of the speeds of rotation and possibly the use of means which prevent blockage of the twist at a point on the cabling path makes it possible to fulfil the conditions enumerated above for obtaining a cable of good quality.

Advantageously, at the inlet and outlet of the loop of the cabling device, in the place where the cable undergoes the major change in direction, means of guiding are provided which prevent the twist from being blocked on these paths of low radius of curvature. These means may comprise at least one idler roller, having a guide groove of which the direction is at an angle to the path of the cable.

According to a preferred embodiment, lapping means are located in the cabling device immediately after the second twister, in the direction of travel of the cable.

The means of lapping may consist of a lapping spindle which can be a conventional rotating bowl spindle inside which is located the bobbin of lapping wire. Advantageously, it is caused to rotate by the same means which drive the cabling device.

In order that the invention will be better understood, the following description is given, merely by way of illustration, reference being made to the accompanying drawings, in which.

Figure 1:
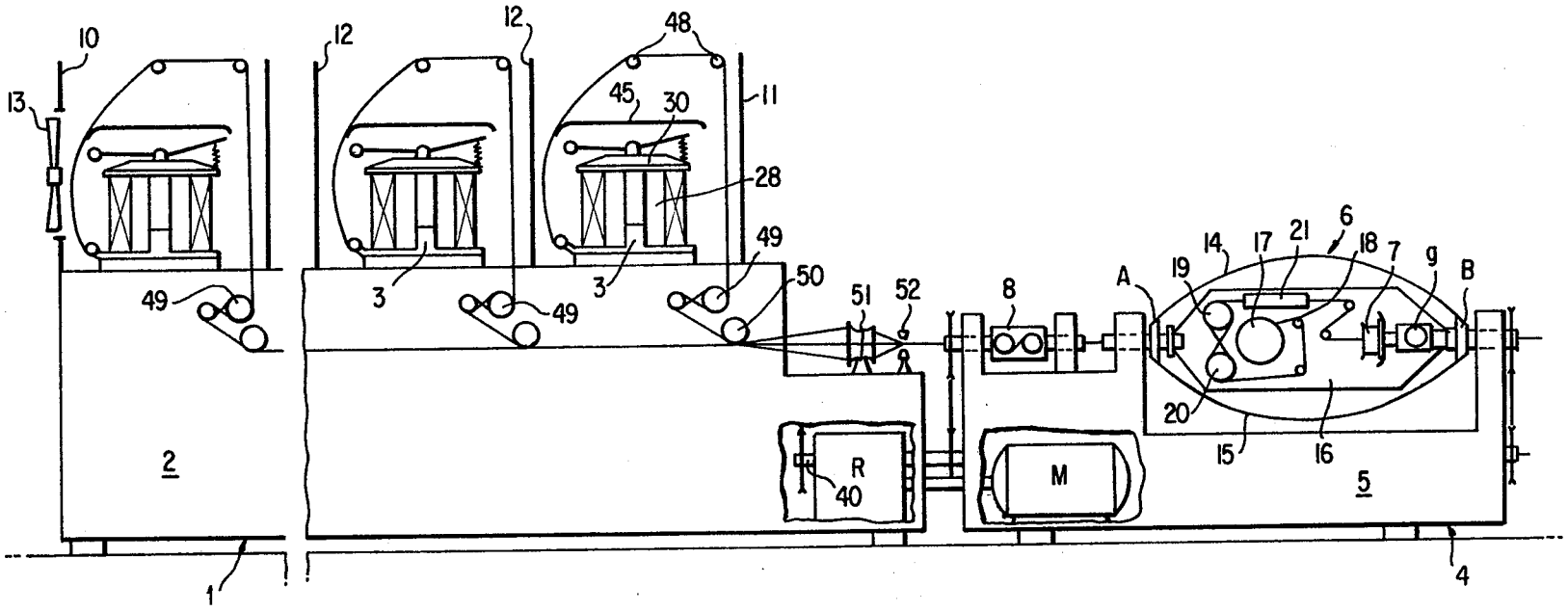
FIG. 1 is a schematic front view of one embodiment of the stranding-cabling machine according to the invention.
Figure 2:
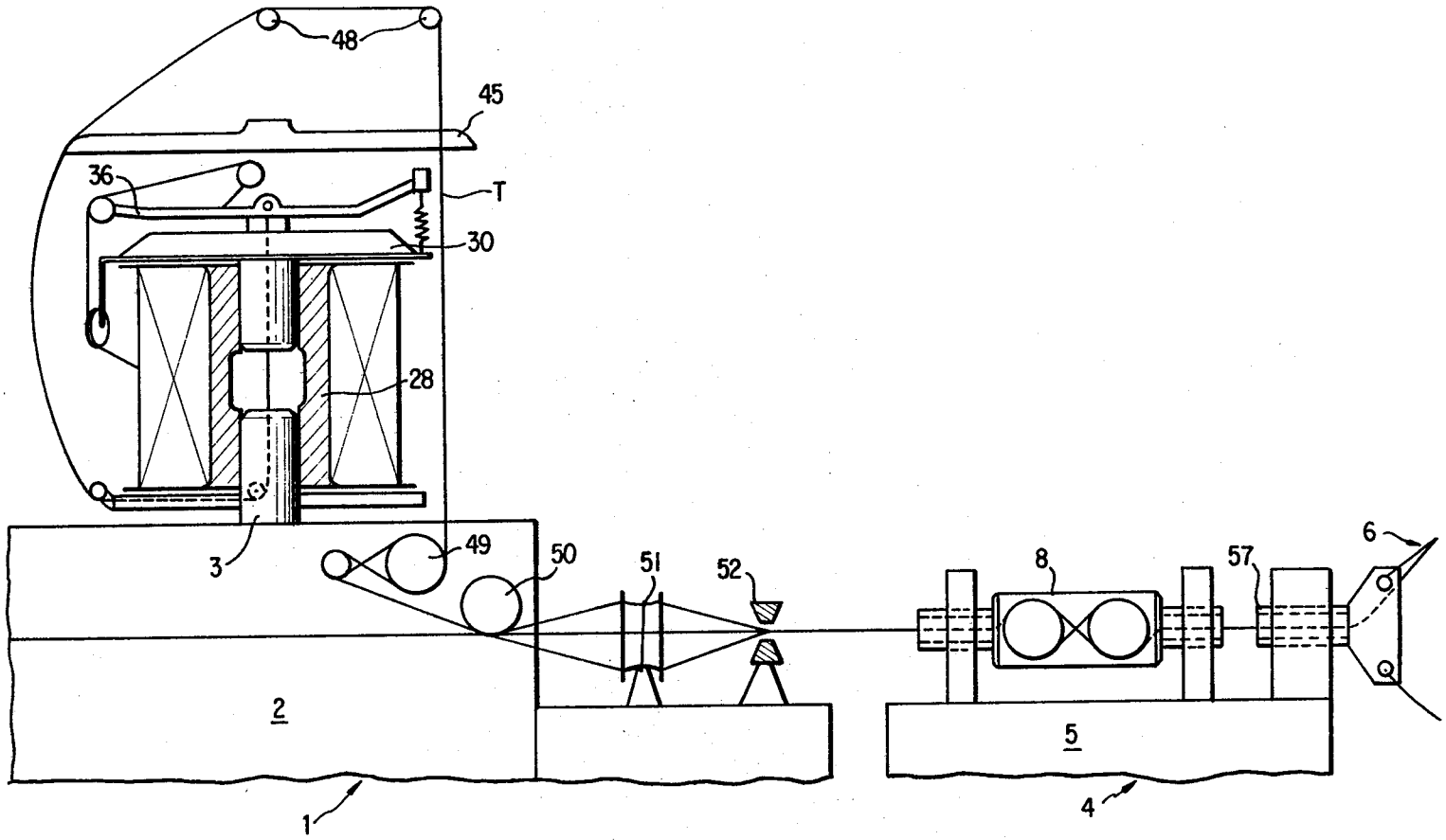
FIG. 2 is a partial front view of the machine according to FIG. 1.

The machine according to the drawings has been designed for the manufacture of lapped cables which can comprise up to seven strands; each strand can comprise any number of wires, advantageously between two and four. The machine comprises two main parts: a stranding battery 1 comprising a frame 2 to which are fixed seven stranding spindles 3, and a cabling device 4 comprising a frame 5 carrying a cabling spindle 6, its associated devices, a lapping spindle 7, an external twister 8 and an internal twister 9.

In FIG. 1, the frame 2 has been broken and only three stranding spindles are shown. The spindles are of the double-twist delivery type. The delivery is effected by a braked bobbin cap type, where the braking can be regulated in order to control the delivery tension. A spingle 3 is shown in detail in FIG. 3. The spindle 3 comprises a driven rotor 25 and carries, via bearings 26, a stator or plate 27 on which is located the bobbin of wires 28. The plate 27 is immobilised by means of magnets 29. The bobbin 28 carries a coil of two to four wires F side by side. The bobbin 28 directly supports the delivery bobbin cap 30. The bobbin cap 30 is firmly fixed to a bobbin cap shaft 31 which is mounted so as to revolve in a boss 32 which can be firmly fixed to the bobbin 28 in a detachable manner.

At its upper part, the boss 32 is so constructed as to support a braking mechanism of any known type, for example of the friction type or the hysteresis type.

On the bobbin cap 30 is mounted an arm 36 which acts on the braking system so as to control the delivery tension of the wires.

Figure 3:
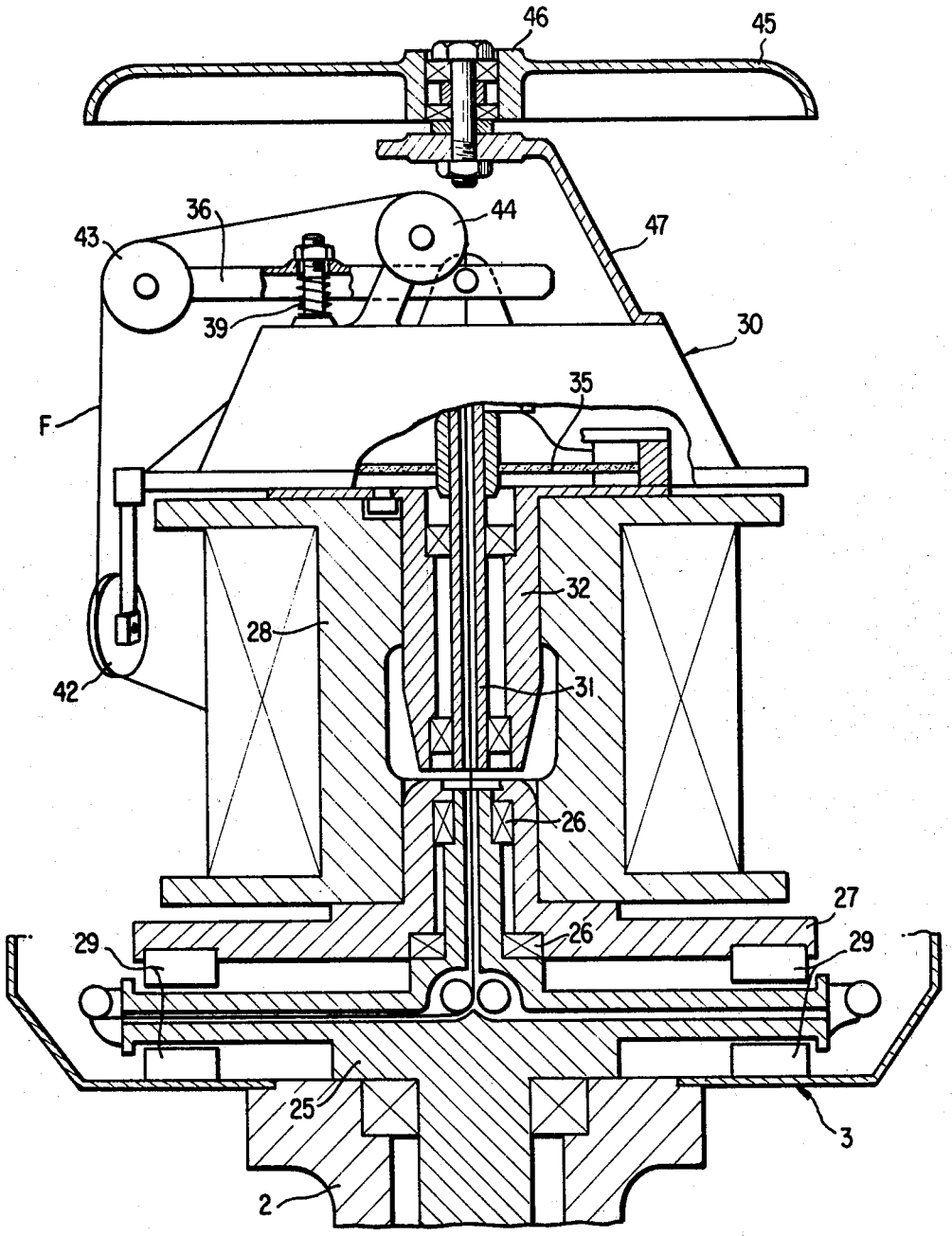
FIG. 3 is a detailed cross-section of a stranding spindle of the machine according to FIG. 1.

A friction mechanism comprising a friction disc 35 firmly fixed to the shaft 31 has been shown schematically in FIG. 3.

A rotary balloon distance-keeper 45 is mounted via bearings 46 on a tripod 47 which is firmly fixed to the bobbin cap 30. Its object is to prevent contact of the strand with the delivery devices, bobbin cap and the like.

Figure 4:
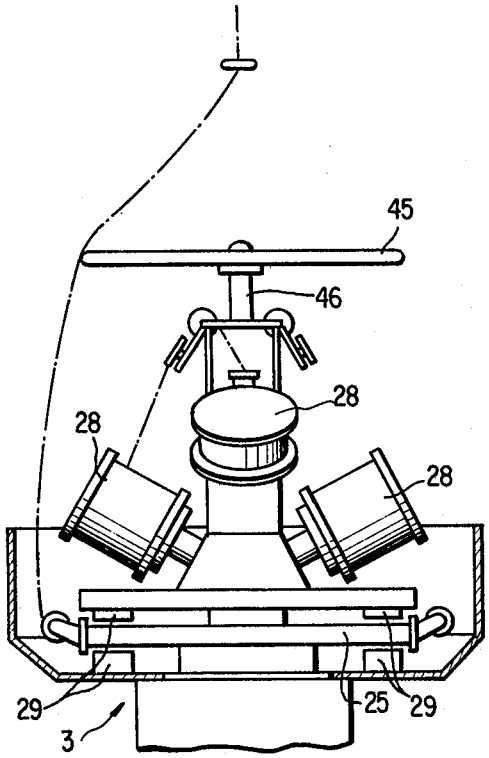
FIG. 4 is a cross-section of another embodiment of a stranding spindle of the machine according to FIG. 1.

Another embodiment of the stranding spindles 3 has been shown in FIG. 4, in which each wire is wound up individually on a bobbin. The four bobbins 28 which the spindle supports are arranged at two levels and staggered by 90° from one level to the other. This embodiment is described in French Pat. No. 2,183,429.

The wire is delivered as the bobbins unwind and the bobbins are braked by a hysteresis brake.

The stranding spindles are driven from a motor M and a reduction gear R (FIG. 1) by a main drive shaft 40 and a power take-off point, with change of direction, for each spindle. It is possible to change the speed and direction of rotation of the spindles by changing the gearwheels of the direction-changing device.

Each spindle 3 is associated with a capstan 49, located on the face in front of the stranding battery 1 and intended to draw off the stand guided by small guide rollers such as 48.

The seven capstans which consitute the 1st traction stage are driven from a shaft 40 by a gear transmission with appropriate speed reduction. The front face of the stranding battery comprises grooved idler godets 50, for guiding the assembly of the strands to a preformer 51 and a convergence die 52 mounted on the stranding battery coaxially with the twister 8 and the cabling spindle 6.

The stranding battery is covered by a hood which forms a box which is soundproofed and can be opened from the front by means of a vertically sliding flap, so as to allow access to the spindles. This hood is partially shown by its vertical end walls 10 and 11. Vertical dividing walls 12 are located between the spindles, principally in order to prevent a broken wire from winding itself around the wires of the adjacent spindles. The end wall 10 carries a fan 13 of high output and low pressure, for cooling the soundproofed box. For the purpose of circulation of air inside the box, the walls 12 are provided with ventilation openings; an outlet orifice is provided on the wall 11. The hood, suitably reinforced, also serves for the attachment of the guide rollers 48.

Figure 5:
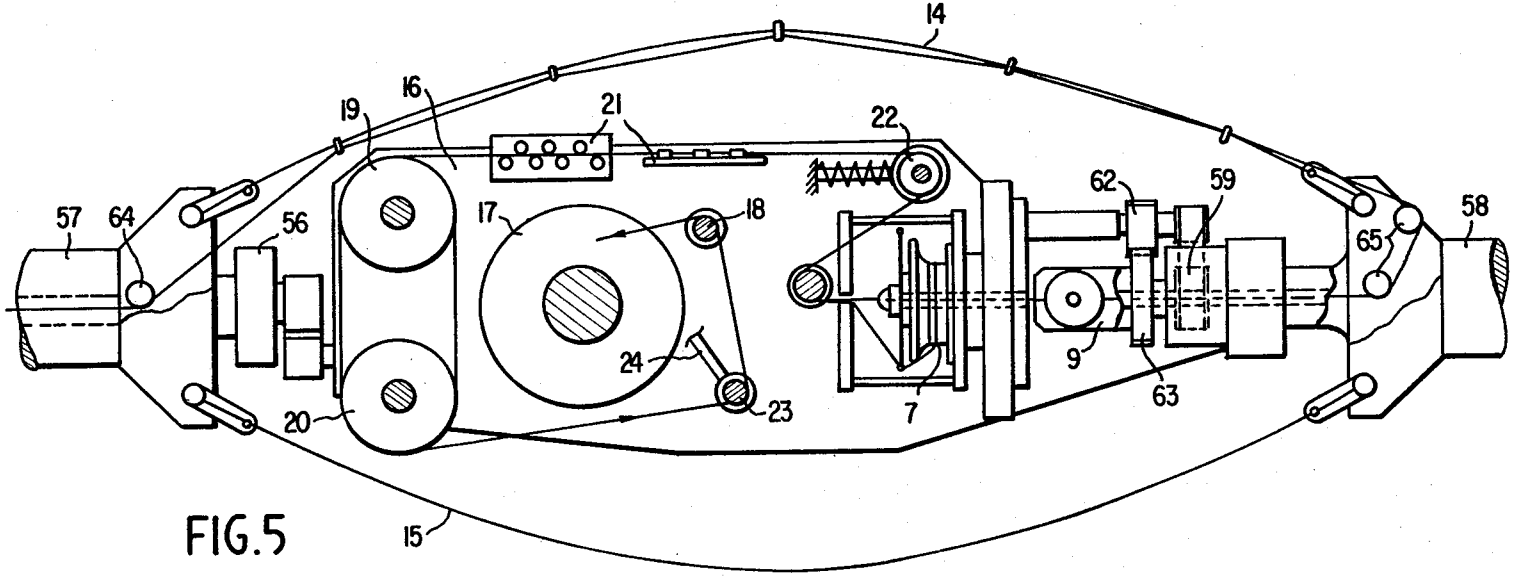
FIG. 5 is a detailed front view of the cabling spindle of the machine according to FIG. 1.

The cabling device 4 is located downstream from the stranding battery 1, its frame 5 carrying the cabling spindle 6 shown in detail in FIG. 5. This is a horizontal wind-up spindle with double loops 14–15. One of the loops serves to guide the cable whilst the other is provided for dynamic balancing. As can be seen in FIG. 5, each loop consists of two arcs 53, 54 which carry guides 55 for the cable; these arcs are fixed to the extensions of the axes 57, 58 which support the spindle.

Inside the spindle is located a fixed cradle 16 which carries a wind-up bobbin 17 mounted between centres, a laying device 18 with crossed wires which are interchangeable a capstan 19 referred to as the main capstan, and its counting wheel 20, a pulley-type elastic stretching system 22, and a straightening device 21 with two sets of straightening rollers carrying a device for detecting broken wires. The lapping spindle 7 is also located inside the cabling spindle 16. These two spindles are caused to rotate by the motor M. The bobbin 17, the laying device 18 and the capstan 19 are also driven by the motor M by means of an axial power take-off point 56. The bobbin 17 is driven via a friction clutch, the slipping of which is controlled in accordance with the desired wind-up tension for the cable so as to regulate the said wind-up tension. For this purpose, the cable passes over the floating pulley 23, mounted on a lever 24, which acts on the clutch control. In the case of an increase of tension caused by an increase in the peripheral speed due to the increase in size of the coil, movement of the lever acts on the clutch control so as to increase the slipping of the clutch and hence to reduce the force and speed of the drive.

The lapping spindle 7 can be of any known type and advantageously has a delivery bobbin cap. The frame 5 also carries the twisters 8 and 9. The twister 8, with two pulleys, is located at the inlet of the cabling spindle 6. It is driven by the motor M via means which are not shown and comprise a device for reversing the direction of rotation, and a device for varying the speed. The second twister 9 is mounted on the cradle 16 of the cabling spindle 6, along the axis of the latter, and immediately after the cable leaves the loop. It is caused to rotate by an axial power take-off point 59, via interchangeable gears 62, 63.

At the point of change of direction of the cable, at the loop inlet and at the loop outlet, one or more guide pulleys 64, 65 are located. To avoid blockage of the twist at these guide pulleys, the latter are inclined on their axis so that their peripheral groove is at an angle with the path of the cable.

The combination of the two twisters 8 and 9 and the inclination of the guide pulleys 64, 65 on their axis makes it possible to bring about the conditions required for obtaining a cable of good quality which is free from faults such as loops, irregular twist and the like.

These conditions, which we have indicated previously, are as follows:

(a) assembly of the strands substantially under the nominal value of twist C.

(b) at the inlet to the cabling spindle; draw-off of each strand in accordance with the length required, taking into account the position of the strand in the cable.

(c) over-twisting of the cable so as to set the true twist imparted to a cable of which the strands have their definitive twist configuration.

Figure 7:
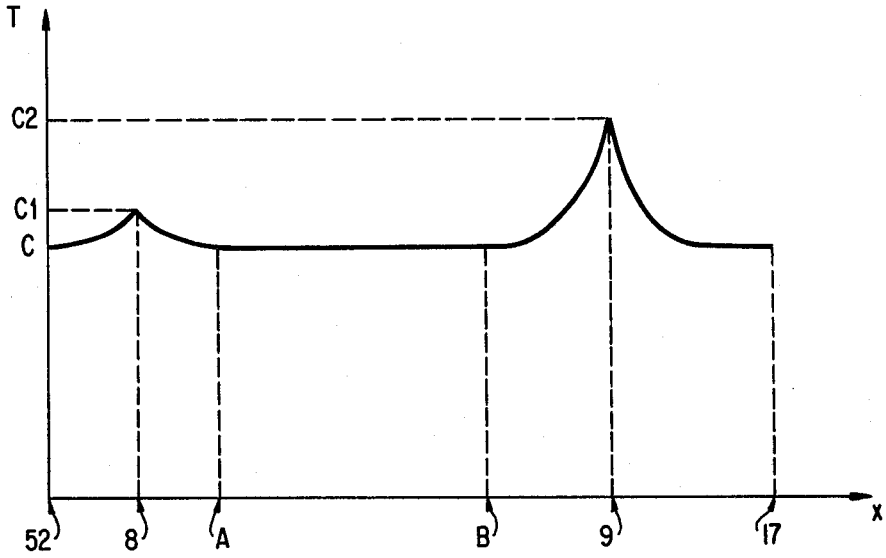
FIG. 7 is a graph illustrating the variation in the twist of the cable along its path.
Figure 6:
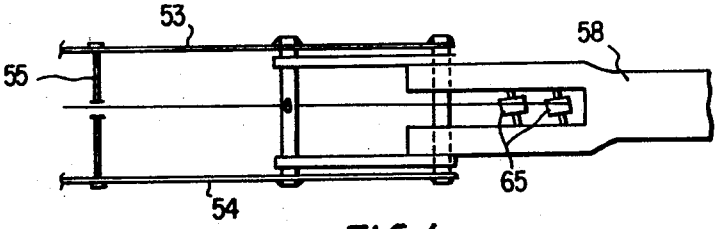
FIG. 6 is a partial plan view of the stranding spindle of FIG. 4.

The advantages of the invention as regards the twist setting are shown in FIG. 7, which is a diagram which represents the value of the twist T of the cable along its path *x* between the assembly die 52 and the collecting bobbin 17. The first twister 8, the role of which is to draw off the correct lengths of each strand and to impart essentially the nominal twist, rotates at a speed which gives a twist C 1 which is slightly greater than the cabling twist C.

If N/2 is the speed of rotation of the spindle 6, the twister 8 will revolve at a speed N1 which is slightly greater than N.

Taking into account the friction which resists the moving backwards, to the assembly point at 52, the twist substantially has a value C so that conditions (a) and (b) are fulfilled. The twister 9 acts on a cable which has its definitive assembling twist (secondary twist) and which consists of strands which have their definitive assembling twist (primary twist) so that condition (c) is fulfilled. The twister 9 turns at a speed $N_2$ which is greater, by about 30 to 40%, than N, so as to ensure, through the overtwist C2, a sufficient plastic deformation to set the twist C of the cable. The inclined rollers 64, 65 make it possible to avoid any substantial blockage of the twist at the inlet A and outlet B of the loop. Between the points A and B, the twist is near the nominal twist C.

The role of the pre-former 51 located upstream from the die 52 is to impart a sinuous configuration to the strands, which assists their placement in the cable and hence makes it possible to prevent opening-up of the cable when it is cut.

The preformer consists, in the conventional way, of three plates having holes therethrough. On each plate, the holes are advantageously arranged around a circle. The three holes corresponding to the passage of the same strand over the three plates are non-aligned, so as to give a sinuous path, the unit being adjustable.

The traction means for the cable and of the strands consist of seven primary capstans 49 (one per stranding spindle) mounted on the stranding battery and a secondary capstan 19 mounted on the cradle 16 inside the cabling spindle 6. The seven primary capstans are driven by the motor M and the speed regulator R at a linear speed which is 3–6% greater than that of the capstan 19, so as to avoid any stretching allowing, where appropriate, for shortening due to cabling.

The tension control between the two capstan stages is achieved in accordance with the grip/non-grip principle by winding around the capstans 49 a defined adjustable number of turns which just allow driving to take place whilst preserving the possibility of slip. The principle of operation of this system has been described above. The use of two stages of capstans is of great value because it makes it possible to reduce very greatly the tension of the cable and of the strands along the entire path. By virtue of its principle, the capstan being a force step-down device, the tension downstream is markedly less than the tension upstream, and the ratio can be 1 to 4 and even 1 to 10. This ratio can be varied by changing the number of passes of the wire (or strand) around the capstan. By way of example, we will consider a cable of seven strands, a tension of 7 kg upstream from each capstan and and upstream/downstream tension ratio of 7/1. The sum of the tensions of the seven strands upstream from the pre-former 51 is 7 kg. Taking into account the increase in tension caused by passing the barriers produced by the pre-former the twisters and the like, the tension at the capstan 19 is from 15 to 18 kg. Without the primary capstans 49, the tension at the secondary capstan 19 would be of the order of 70 to 75 kg. By virtue of the reduction in tension brought about by the two-stage traction, the frequency of breakage of the strand or cable is reduced considerably. Furthermore, the setting of the twist is easier and the product is of better quality. Furthermore, the force which has to be provided by the mechanical devices is reduced and therefore the problems of resistance to mechanical wear of these devices are eliminated.

In operation, the seven strands coming from the seven spindles 3 are drawn off by the primary capstans 49, pass into the pre-former 51 and are then assembled at the die 52 at the inlet of the twister 8. The cable which is being formed, and is drawn by the capstan 19, passes through the twister 8, one loop 14 of the cabling spindle 6, the twister 9 and the lapping spindle 7, where it receives its lapping wire; it then passes over the stretching pulleys 22, between the straightening rollers of the straightener device 21, into the device for detecting broken wires, around the capstan 19 and its counting wheel 20, over the floating pulley 23 and over the laying device 18, and is finally collected on the bobbin 17. The machine described above has been studied for the manufacture of a lapped cable from individual wires of which the diameter can advantageously vary between 0.150 and 0.300 mm, the lapping wire usually employed being a wire of 0.100 to 0.150 mm diameter.

It is possible to manufacture a non-lapped cable by simply taking the lapping spindle out of service.

An example of the cables which can be manufactured on the present machine is:

| | |
|---|---|
| 7 × 4 − 0.220 + 1 − 0.150 | lapped |

This must be read as meaning: a cable of 7 strands of 4 wires, each wire having a diameter of 0.220 mm + 1 lapping wire of diameter 0.150 mm.

Other examples:

| | |
|---|---|
| 7 × 4 − 0.220 | not lapped |
| 7 × 4 − 0.175 + 1 − 0.150 | lapped |
| 7 × 3 − 0.200 + 1 − 0.150 | lapped |
| 3 × 4 − 0.220 | not lapped |

Obviously, these examples do not imply a limitation and it is possible to manufacture all kinds of cables of, for example, 2 to 7 stands, each strand preferably having 2 to 4 wires.

The twists can advantageously be set as follows:

| | | |
|---|---|---|
| stranding | S or Z = | 0 to 200 turns/meter |
| cabling | S or Z = | 0 to 150 turns/meter |
| lapping | S or Z = | 100 to 500 turns/meter. |

The various sub-assemblies of the machine are intended to revolve at the following mean speeds:

| | Mean speed |
|---|---|
| stranding spindle | 2,500 rpm |
| cabling spindle | 1,000 rpm |
| lapping unit | 8,500 rpm |
| twister | 3,000 rpm |

The attached table, which is given by way of example, is a table which summarises the various combinations of twists and of the corresponding speeds of rotation of the stranding spindles, cabling spindles, lapping spindles and twisters generally employed for the manufacture of standard 7 × 3 or 7 × 4 cables. In this example, taking into account twists in the opposite direction when stranding and when cabling, the twist imparted when stranding is T + C, T being the nominal twist of the strand and C the cabling twist. In effect, when cabling, the strand will be untwisted by C turns/meter and will retain its nominal twist T. This untwist (−C), which with the values chosen in the example is at least 33%, corresponds approximately to the mean overtwist required to stabilise a strand. Consequently almost stable strands are present in the cable. Their twist reaction is more sensitively adjusted by means of the twisters.

The example described can have numerous modifications made thereto.

As regards the stranding, the adjustment of the delivery tensions can be made by discontinuously varying the braking torque.

As regards the traction, the capstans 49 can be replaced by a single capstan with several, e.g. seven tracks.

As regards the lapping, it is possible to lap simultaneously with two wires, which makes it possible to increase the speed and hence the output.

The arrangement whereby the capstan or capstans 49 is or are subject to control by the capstan 19 can be achieved by mechanical, electrical, electronic or other means.

It is also possible, without going outside the scope of the invention, to conceive other variants with respect to cabling and the twister.

TABLE SUMMARISING THE VARIOUS USUAL COMBINATIONS OF TWISTS, AND THE CORRESPONDING SPEEDS OF ROTATION OF THE STRANDING, CABLING AND LAPPING SPINDLES AND OF THE TWISTER.

| | Stranding T | Cabling C | $\frac{T}{C}$ | Lapping G | $\frac{G}{C}$ | Twister 9 | Twister 8 |
|---|---|---|---|---|---|---|---|
| Turns/m | 75 + 50 = 125 | 50 | 2.5 | 200 | 8 | 1.5 × 2 C | 1.1 × 2 C |
| Speed of rotation, rpm | 2650 | 1060 | | 8500 | | 3180 | 2332 |
| Turns/m | 75 + 100 = 175 | 100 | 1.75 | 200 | 4 | 1.5 × 2 C | |
| Speed of rotation, rpm | 3700 | 2125 | | 8500 | | 6375 | 4675 |
| Turns/m | 75 + 50 = 125 | 50 | 2.5 | 400 | 16 | 1.5 × 2 C | 1166 |
| Speed of rotation, rpm | 1325 | 530 | | 8500 | | 1590 | |
| Turns/m | 75 + 100 = 175 | 100 | 1.75 | 400 | 8 | 1.5 × 2 C | 2336 |
| Speed of rotation, rpm | 1850 | 1060 | | 8500 | | 3180 | |
| Turns/m | 150 + 50 = 200 | 50 | 4 | 200 | 8 | 1.5 × 2 C | 2336 |
| Speed of rotation, rpm | 4250 | 1060 | | 8500 | | 3180 | |
| Turns/m | 150 + 100 = 250 | 100 | 2.5 | 200 | 4 | 1.5 × 2 C | 4675 |
| Speed of rotation, rpm | 5300 | 2125 | | 8500 | | 6375 | |
| Turns/m | 150 + 50 = 200 | 50 | 4 | 400 | 16 | 1.5 × 2 C | 1166 |
| Speed of rotation, rpm | 2125 | 530 | | 8500 | | 1590 | |
| Turns/m | 150 + 100 = 250 | 100 | 2.5 | 400 | 8 | 1.5 × 2 C | 2336 |
| Speed of rotation, rpm | 2650 | 1060 | | 8500 | | 3180 | |
| Turns/m | 100 + 50 = 150 | 50 | 3 | 300 | 12 | 1.5 × 2 C | 1562 |
| Speed of rotation, rpm | 2125 | 710 | | 8500 | | 2130 | |
| Turns/m | 100 + 50 = 150 | 50 | 3 | 150×2 | 6 | 1.5 × 2 C | 3124 |
| Speed of rotation, rpm | 4250 | 1420 | | 8500 | | 4260 | |

I claim:

1. A machine for continuous stranding and cabling for the manufacture of a cable from single wires comprising (A) a stranding battery including
a plurality of delivery spindles;

(B) double-twist cabling means including
a substantially horizontal spindle,
a fixed cradle,
a winding station on said fixed cradle, and
cabling guide means for guiding the cable along a double-twist path about said fixed cradle;

(C) traction means including first drive means engaging said strands and second drive means engaging the cable, and means for correlating the speeds thereof so that the speed of the first drive means is at least equal to the speed of the second drive means;

(D) a first twister intermediate said stranding battery and the inlet of said double-twisted cabling means; and (E) overtwist means including a twister on said fixed cradle and positioned coaxially with said spindle to receive the cable from said cabling guide means.

2. A machine as claimed in claim 1, and further including lapping means associated with the cabling unit.

3. A machine as claimed in claim 1, wherein the stranding battery includes aligned vertical double-twist spindles carrying bobbins of single wire and means for regulating the delivery tension of the wires.

4. A machine as claimed in claim 1 including means for regulating the direction and speed of rotation of said first twister.

5. A machine as claimed in claim 1, wherein the cabling guide means includes double loops.

6. A machine as claimed in claim 5, wherein guide means which allow the twist to run back are located at the inlet and outlet of the cabling guide loop through which the cable travels.

7. A machine as claimed in claim 2, wherein the lapping means includes a lapping spindle mounted on the fixed cradle coaxially with the spindle.

8. A machine as claimed in claim 1, wherein the second drive means of the traction means includes a capstan mounted on the fixed cradle of the cabling spindle.

9. A machine as claimed in claim 8, wherein the first drive means includes a single capstan for all the stranding spindles.

10. A machines as claimed in claim 8, wherein the first drive means includes a capstan for each stranding spindle.

11. A machine as claimed in claim 1, wherein the speed of the first driven means is greater, by between 1 and 10%, than that of the second drive means.

(E) overtwist means including a twister on said fixed cradle and positioned coaxially with said spindle to receive the cable from said cabling guide means.

12. The method of forming cable from individual wires comprising stranding a plurality of said wires to form a plurality of strands;

assembling and advancing a plurality of said strands;

p1 imparting the selected final twist to the associated strands while cabling the strands in a double-twist loop cabling step;

overtwisting the cable within the zone defined by the loop to stabilize the selected final twist; and winding the finished cable.

13. The method of claim 12 including advancing said assembled strands at a speed slightly in excess of the speed of the cable in the cabling step.

14. The method of claim 13 including the step of pre-forming said assembled strands.

15. The method of claim 14 in which the assembled strands are advanced at a speed between 2% and 6% in excess of the speed in the cabling step.

* * * * *